United States Patent [19]

Scully

[11] Patent Number: 4,796,336

[45] Date of Patent: Jan. 10, 1989

[54] TWO PART BUCKLE

[75] Inventor: Andrew J. Scully, Macomb, Mich.

[73] Assignee: The United States of America as represented by the Secretary of the Army, Washington, D.C.

[21] Appl. No.: 82,880

[22] Filed: Aug. 5, 1987

[51] Int. Cl.[4] ..... A44B 21/00

[52] U.S. Cl. ..... 24/68 CD; 24/68 E; 24/71 ST; 24/196

[58] Field of Search ..... 24/68 R, 68 SB, 68 CD, 24/68 A, 68 E, 68 T, 307, 308, 311, 71 R, 71 T, 71 ST, 71 SB, 71 TD, 191, 193, 194, 196, 171

[56] References Cited

U.S. PATENT DOCUMENTS

| | | | |
|---|---|---|---|
| 1,447,967 | 3/1923 | Davis | 24/311 |
| 2,429,926 | 10/1947 | Davis | 24/311 X |
| 2,997,761 | 8/1961 | Davis | 24/68 E |
| 3,252,188 | 5/1966 | Davis | 24/68 E |
| 3,703,024 | 11/1972 | Johnson | 24/71 R X |
| 4,389,756 | 6/1983 | Kasama | 24/171 |
| 4,464,811 | 8/1984 | Holmes | 24/68 CD |

FOREIGN PATENT DOCUMENTS

| | | | |
|---|---|---|---|
| 546103 | 6/1942 | United Kingdom | 24/68 E |
| 2165880 | 4/1986 | United Kingdom | 24/196 |
| 2167510 | 5/1986 | United Kingdom | 24/191 |

*Primary Examiner*—Peter A. Aschenbrenner
*Assistant Examiner*—James R. Brittain
*Attorney, Agent, or Firm*—Peter A. Taucher; Gail S. Soderling

[57] ABSTRACT

A two part, over center buckle for belting. The buckle has a retention member on one part of the buckle which will engage a detent on the second part of the buckle when the buckle is closed. The retention member holds the buckle closed against normal vibration and jarring.

1 Claim, 1 Drawing Sheet

TWO PART BUCKLE

GOVERNMENT INTEREST

The invention described herein may be manufactured, used, and licensed by or for the Government for governmental purposes without payment to me of any royalty thereon.

BACKGROUND

In one aspect, this invention relates to belt and strap securing devices. In a further aspect, this invention relates to two part buckle structures for fastening belt structures.

In general, various buckle and clamp mechanisms have been proposed and used to fasten a belt or strap around an object to be secured in position. One well known example is the lap seat belt on automobiles and small trucks where two individual belts each having one end fastened to the frame member of the car have complimentary buckle members on the free end which can be brought about an individual's torso and fastened, followed by adjustment of the belt to the proper length to hold the passenger securely in position in the automobile seat.

A more specialized variation of a two buckle mechanism is the two part over center buckle having two buckle members which when combined fasten the belt. In general, one of the buckle members is permanently attached on one end of the belt to be used and the other buckle part allows the belt's length to be adjusted so it can be securely tightened to hold the object being secured firmly in position.

Over center buckles are used with belts to store articles such as cargo which must be firmly secured while being transported. Generally a web strap with a clasp or buckle for fastening is wrapped around the cargo and the two buckle members brought into engagement. An over center type buckle generates sufficient leverage on one of the buckle members to allow tightening of the belt about the cargo as the buckle member is brought to the closed position. Such buckles are generally designed to remain closed once the link goes "over center" and the buckle is brought into the closed position. However, unless the buckle has a positive latching mechanism it is possible for the buckle to open prematurely and accidentally, particularly if the buckle is disturbed such as by being struck during transport.

SUMMARY OF THE INVENTION

The present invention discloses a two part over center buckle having a positive latching means suitable for retaining the buckle in a closed clasped position to minimize the change of accidental opening even if the buckle is disturbed during transport. A buckle of the present invention includes a first buckle member shaped with a body having a projection extending from one end of the buckle so as to form a retention member suitable for engagement as will be explained later.

More specifically, a rectangular slot is formed in the buckle member approximately parallel to the base member and a sliding retention bar mounted within the slot extending transversely across the buckle with each end of the retention bar being adapted to move along the slot in the buckle member. A jam bar has its ends attached to the buckle member and extends transversely across the buckle near one end of the slot so that the sliding retention bar can be moved to a belt retaining position. In the retaining position, a belt passed over the retention bar will be engaged by the jam bar when the sliding bar is in its position closest to the jam bar to hold the belt securely. A detent is formed on the end of the first buckle member nearest the jam bar. The first buckle member has a pair of retention hooks formed on the end of the first buckle member opposite the detent.

A second buckle member has a pair of complimentary arms which have stub shafts extending outward and adapted to engage the retention hook on the first buckle member. A fastening rib extends transversely across the second buckle member to allow a permanent attachment of one end of the belt to the second buckle member. A retention member is located on the end of the second buckle member and formed so as to engage the detents on the first buckle member when the buckle is brought into its closed fastened position.

BRIEF DESCRIPTION OF THE DRAWING

A further understanding may be had by reference to the drawing in which.

DETAILED DESCRIPTION

Figure 1:
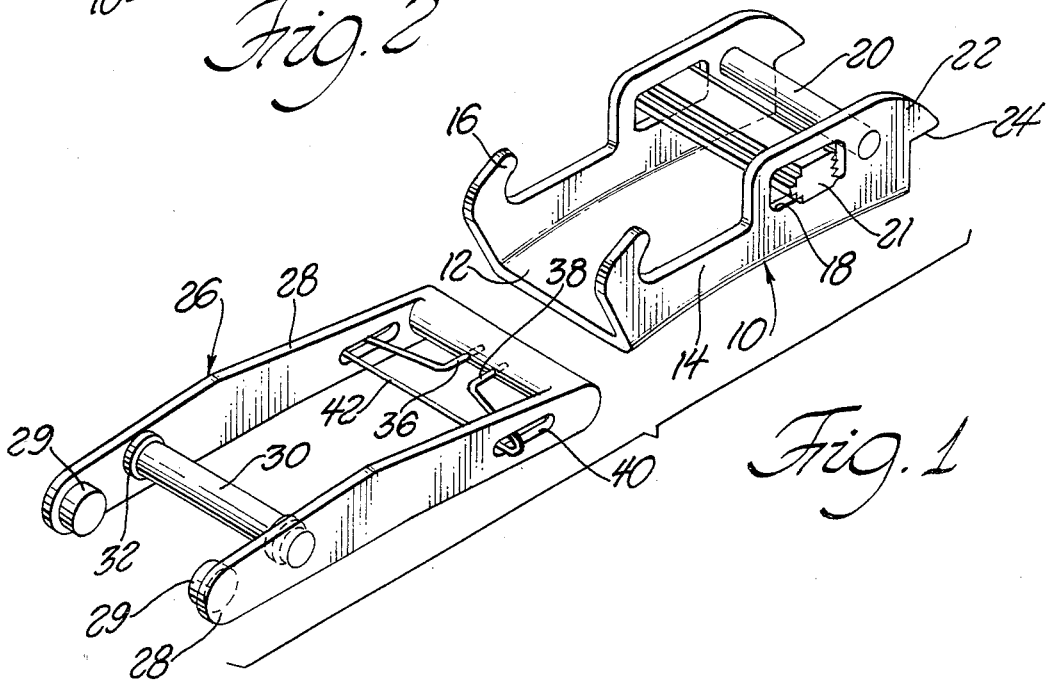
FIG. 1 is an exploded view of the buckle according to the present invention.

Referring to the accompanying drawings in which like numerals refer to like parts and initially to FIG. 1, a buckle according to this invention has a first buckle member 10 with a base 12 and a pair of buckle sides 14 disposed one on each side of the base member and extending upwards at a right angle to the base member. The buckle sides 14 are mounted and extend upward from the base member so as the form an open channel. Each of the buckle sides 14 has a projection 16 which extends from one end of the buckle side back towards the center of the buckle and over a rectangular shape opening extending along the side to form a retaining hook.

A rectangular slot 18 is also formed in the buckle sides 14 with the slot's axis approximately parallel to the longitudinal axis of the first buckle member. A sliding retention bar 21 extends transversely across the buckle each end of the retention bar 21 being retained within one of the rectangular slots formed in the buckle sides 14, the retention bar being mounted for movement along the slot. As shown, the retention bar 21 as a stepped configuration on the side of the bar closest to the center of the buckle member and a toothed surface formed on the opposite surface of the bar. A jam bar 20 has its end permanently affixed to the buckle sides 14 and is located at a point near the sliding bar and parallel thereto. When a belt is looped around the sliding bar and a free end brought back between the sliding bar and the jam bar the sliding bar can be moved to a position near the the jam bar. In this position, the belt will be held firmly between the jam bar and the sliding bar to prevent the belt from loosening. A detent 22 is formed on each side of the first buckle member with a engaging surface 24 located on the bottom side of the detent as viewed in FIG. 1. The engaging surface 24 can co-act with a second buckle member as set forth below.

A second buckle member 26 is formed with a pair of opposed parallel sides 28 having a short stub shaft 29 formed on each side of the second buckle member and extending inward towards the interior of the buckle member. A fastening rib 30 extends transversely across the second buckle member 26 and has one end anchored in each of the sides 28 to firmly hold the rib and sides together. Collars 32 are attached to the transverse fastening rib 30 near the side 28 and extend outward from the rib's surface to keep the belt centered between the collars. A retention rod 34 extends transversely across the second buckle member 26 at the end furthest removed from the fastening rib, each end of the retention rod 34 being attached to one of the individual sides of the buckle member. The retention rod 34 and fastening rib 30 serve to keep the sides 26 of the second buckle member in alignment. A retaining spring 36 is formed in the shape of an open T-section having a pair of parallel extending legs 38 which are anchored in the retention rod 34 and extend longitudinally outward in the interior of the second buckle member. The legs 38 have a transversely extending portion which extends outward toward the sides of the buckle passing through a rectangular aperture 40 formed in the sides 28 of the second buckle member 26 and curving backward through the aperture to form a transversely extending spring arm 42.

Figure 2:
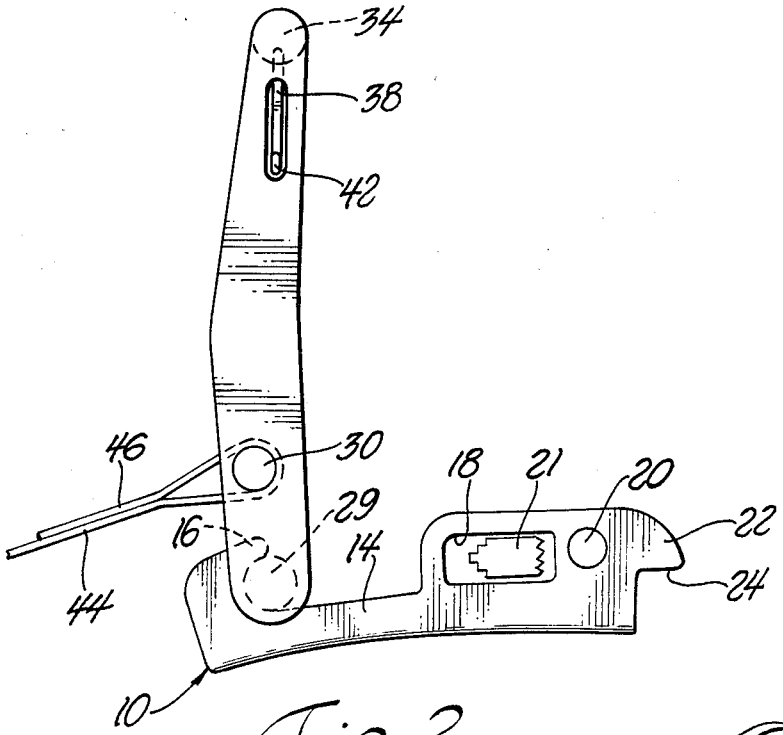
FIG. 2 is a side view of the buckle of FIG. 1 in an engaged and partially closed position.

Referring to FIG. 2 the buckle members of FIG. 1 are shown in an engaged partially closed position with a webbed belt 44 having one end looped around the fastening rib 30 to form a loop, the loop being sewn shut at 46 to form a permanent attachment with the second buckle member. The stub shaft 29 of the buckle member has been placed within the retaining hook of the first buckle member 10 the projection 16 so that the stub shaft is held firmly within the projection allowing the retention rod 34 to be grasped and provide a lever arm for closing the buckle.

As shown, once the stub shaft 29 has engaged the projection the retention rod can be grasped and moved in a clockwise direction to close the buckle.

Figure 3:
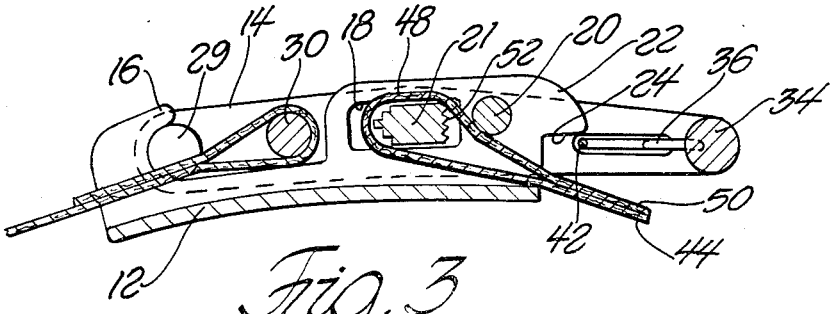
FIG. 3 shows the buckle members of FIGS. 1 in a closed position with the latching mechanism of the buckle engaged.

In FIG. 3 the buckle is shown in the closed position with the belt 44 having been looped around the sliding retention bar 21 to form a loop 48 with the free end 50 of the belt 44 having been brought back between the sliding retention bar and the jam bar 20. In order to tighten the belt the belt's free end 50 can be pulled firmly causing additional belt to be drawn between the jam bar and the sliding bar while the buckle is in the unengaged position. When the buckle is closed the tension on the belt 44 will cause the sliding retention bar 21 to move backwards into the jam bar 20 firmly grasping the free end of the 50 of the belt between the jam bar and the sliding bar to hold it securely in place. As shown, the sliding bar has a serrated surface 52 to provide a more positive grip on the belt and minimize the slippage of the belt back through the jam bar and sliding bar interface when tension is applied to the belt. As shown the retention rod 34 has been moved until the second buckle member lies in a fully engaged position and the retention spring 36 has engaged the detent 22. The transversely extending spring portion 42 lies below the engagement surface 24 in such a manner that as the second buckle member attempts to rotate counterclockwise to the open position the retention spring will engage the surface 24 holding the buckle in the closed position.

The spring arm 42 may be retracted manually to permit the buckle to be opened by lifting the retention rod 34.

I wish it to be understood that I do not desire to be limited to the exact details of construction shown and described for obvious modifications will occur to a person skilled in the art, without departing from the spirit and scope of the appended claims.

What is claimed is:

1. A two part overcenter buckle suitable for attachment to the free end of belting to fasten the ends together including: a first buckle member having a base, a pair of buckle sides mounted on opposite edges of the base each of the buckle sides having hook members formed in the sides of the first buckle member, a rectangular slot formed in each buckle side with the longitudinal axis being approximately parallel to the base member, a sliding retention bar extending transversely across the first buckle member with each end of the retention bar having one end mounted within the slot and adapted for movement along the slot, a jam bar having one end attached to each of the sides and extending transversely across the first buckle member near one end of the slot so that the sliding bar can be moved to a belt retaining position, at least one detent formed on the end of the first buckle member nearest the jam bar; and a second buckle member having a pair of complimentary arms permanently joined so the arms are maintained in a spaced parallel configuration, stub shafts are mounted near one end of the second buckle member, the stub shafts being formed so as to extend inward from the sides of the second buckle member and to engage the hook members and allow rotation of the second buckle member when engaged, means for permanently attaching one end of a belt to the second buckle member, a T-shaped spring member having one leg fixed in the second buckle member and having an arm extending transversely across the second buckle member with the ends of the arm moveably mounted in the sides of the second buckle member located at the end of the second buckle member opposite to the second retention means, and adapted to engage the detent on the first buckle member when the first and second buckle members are in a closed position.

* * * * *